United States Patent [19]

Yackiw

[11] Patent Number: 4,535,564

[45] Date of Patent: Aug. 20, 1985

[54] WEATHERSTRIP MOUNTABLE IN A SLOT

[75] Inventor: Charles Yackiw, Fairport, N.Y.

[73] Assignee: Schlegel Corporation, Rochester, N.Y.

[21] Appl. No.: 550,481

[22] Filed: Nov. 9, 1983

[51] Int. Cl.[3] ..... E06B 7/16

[52] U.S. Cl. ..... 49/489; 49/485

[58] Field of Search ..... 49/475, 493, 489, 479, 49/485; 428/318.6

[56] References Cited

U.S. PATENT DOCUMENTS

| | | | |
|---|---|---|---|
| 1,960,137 | 5/1934 | Brown | 428/318.6 |
| 2,012,625 | 8/1935 | Calcutt | 49/475 |
| 2,933,784 | 4/1960 | Hooverson | 49/489 X |
| 3,469,349 | 9/1969 | Multer | 49/489 X |

FOREIGN PATENT DOCUMENTS

| | | | |
|---|---|---|---|
| 81721 | 9/1963 | France | 49/489 |
| 1507071 | 4/1978 | United Kingdom | 49/485 |

*Primary Examiner*—Kenneth Downey

*Attorney, Agent, or Firm*—Cumpston & Shaw

[57] ABSTRACT

An elongate weatherstrip is described comprising a sealing body of foamed synthetic resin material encased in a very thin, very flexible membrane of substantially 2 mils in thickness or less. The sealing body has elongate sealing and anchoring lobes joined by a narrow rib portion. A flexible elongate anchoring member of uniform cross section of a material less compressible than the synthetic resin material is affixed to the anchoring lobe.

13 Claims, 9 Drawing Figures

WEATHERSTRIP MOUNTABLE IN A SLOT

BACKGROUND OF THE INVENTION

1. Field of the Invention

The present invention relates to weatherstrips, and more particularly to an improved weatherstrip mountable within a slot in one member for sealingly engaging another relatively movable member.

2. Description of the Prior Art

British Patent Specification No. 1,507,071 discloses a weatherstrip mountable within a slot and having an elongated body of resilient foamed synthetic resin material. The weatherstrip has an elongate anchorage member more rigid than the body and formed of synthetic resin material. The body has a narrow neck portion joined to the anchorage member. A skin of synthetic resin material encloses and is secured to the body and anchorage member.

A weatherstrip similar to the weatherstrip disclosed in British Specification No. 1,507,071 is known in which the anchorage member of synthetic resin material is replaced by an anchorage member of paper having a low coefficient of thermal expansion.

U.S. Pat. No. 3,761,347 discloses a pressure sensitive weatherstrip formed of a length of resilient material having a pair of legs extending outwardly at about a right angle to each other. The free ends of the legs curve back on themselves and extend inwardly at acute angles to the legs. The weatherstrip has a third anchoring leg of hookshaped cross section for insertion into a slot.

The prior art weatherstrips are made in indefinite lengths and then cut to the desired lengths for particular installations. The weatherstrip can be used to seal the space between any two relativey movable members, such as windows and doors relative to window and door frames, for example. A problem occurs where the seal surfaces abruptly deviate from a straight path, for example at the corners of a window or door. In such cases, an attempt to bend the weatherstrip at right angles causes deep wrinkling of the weatherstrip at the corner resulting in leakage to occur there. To overcome this problem, the weatherstrip is cut into pieces instead of using a continuous strip, and the abutting or overlapping ends of two strips at a corner are sealed together. This procedure is time consuming and not completly effective in eliminating air or moisture leakage at the corner.

A second problem relates to the use of weatherstrips in applications where the ambient temperature changes greatly such as from season to season. Where such weatherstrips are made from plastic material such as those shown in U.S. Pat. No. 3,761,347, the length of a long section of weatherstrip may change substantially as the temperature changes so that, for example, in the winter, the weatherstrip shrinks leaving gaps at the ends and does not completely seal a door or window.

SUMMARY OF THE INVENTION

In accordance with a preferred embodiment of the invention, a weatherstrip is disclosed comprising an elongate sealing body of resilient foamed synthetic resin material of uniform cross section encased in a very thin, very flexible membrane or film of substantially 2 mils in thickness or less. The sealing body has a pair of elongate sealing and anchoring lobes joined by a narrow elongate rib portion of resilient foamed synthetic resin material of uniform cross section. A flexible elongate anchoring member of a uniform cross section and of a material less compressible than the synthetic resin material is affixed to the anchoring lobe and cooperates therewith for releasably holding the anchoring lobe in a slot.

In a more specific aspect of the invention, the anchoring member comprises a paper strip of a substantially hook-shaped cross section.

A weatherstrip constructed in accordance with the invention provides a simple, convenient and highly effective way of solving the aforementioned weatherstrip corner-leaking problem. By reducing the thickness of the weatherstrip coating or skin by casting, spray coating or dipping techniques, the flexibility of the weatherstrip is greatly increased so that it is possible to bend a continuous weatherstrip around a right angle corner with minimal wrinkling of the strip. This substantially eliminates air or moisture leakage at the bend.

Constructing the anchoring member of the weatherstrip from a flexible strip of material of substantially hook-shaped cross section enclosing the end portion of the anchoring lobe provides an improved means for mounting the weatherstrip in a slot, and solves some special weatherstrip mounting problems. One leg of the strip forms a rigid surface for guiding the anchoring member of the weatherstrip into a slot. The other leg cooperates with the slot and the resilient anchoring lobe for releasably retaining the mounted weatherstrip in the slot.

The invention and its advantages will become more apparent from the detailed description of the invention presented below.

BRIEF DESCRIPTION OF THE DRAWINGS

The details of the invention will be described in connection with the accompanying drawings, in which.

DETAILED DESCRIPTION OF THE INVENTION

Figure 1:
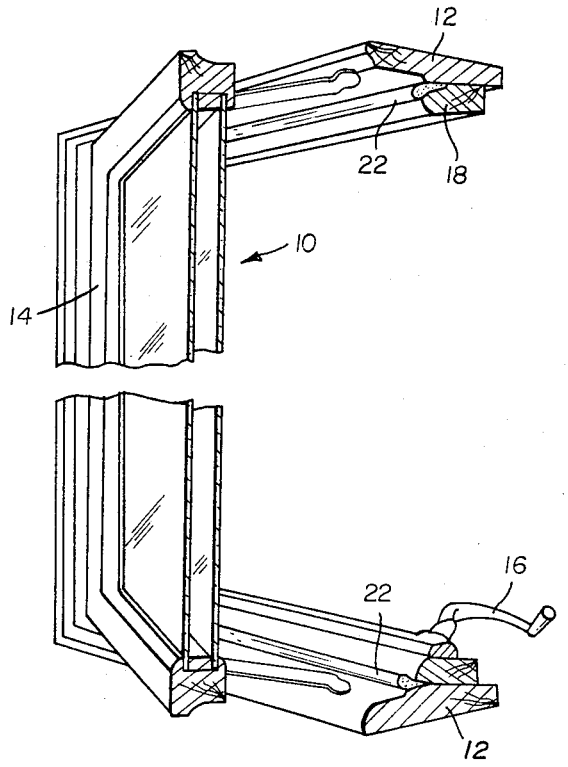
FIG. 1 is a segmental view in section of a casement window in which a preferred embodiment of the weatherstrip of this invention is embodied.
Figure 2:
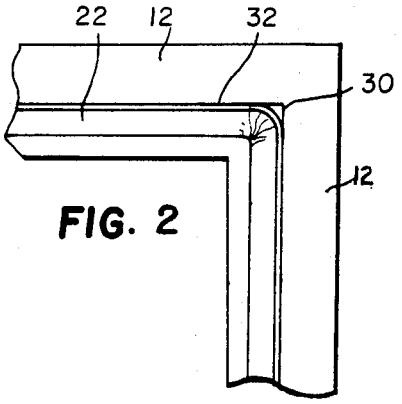
FIG. 2 is a segmental side elevational view of the casement window of FIG. 1 showing the weatherstrip bent around a corner.
Figure 3:
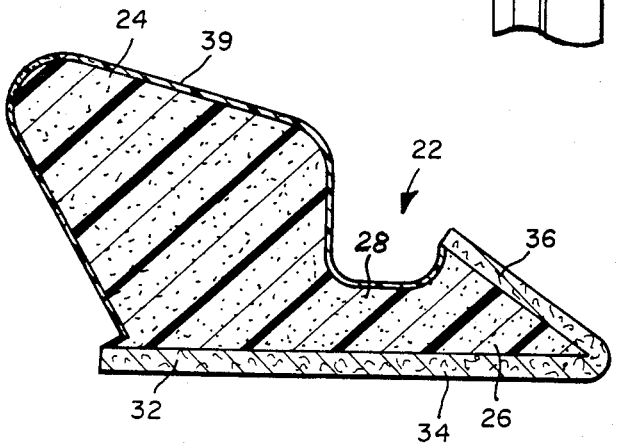
FIG. 3 is an enlarged view in section of the weatherstrip of FIG. 1 shown in its normal expanded position.
Figure 4:
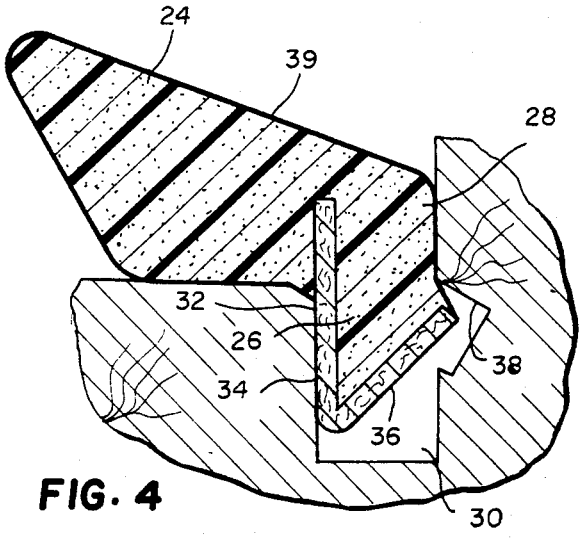
FIGS. 4–9 are views similar to FIG. 3 disclosing other preferred embodiments of the invention.
Figure 5:
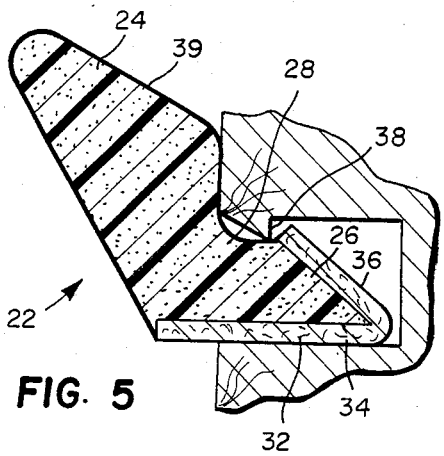

With reference to FIGS. 1–3, a casement window 10 of conventional type comprising a window sash 14 is mounted on frame members 12 for swingable movement in the direction of the arrows on vertically oriented hinges, not shown. Window sash 14 is moved toward and away from frame members 12 by any suitable rotating handle 16 and linkage, shown in part, coupling the handle to the window and frame members.

Weatherstrip 22 is interposed between surface of window sash 14 and the frame members for preventing passage of air or moisture past the sash while in its closed position, as seen in FIG. 1. The elongate weatherstrip 22, as best seen in FIG. 3, comprises a sealing lobe 24 and an anchoring lobe 26 joined together by an elongate rib portion 28. Lobes 24, 26 and rib 28 are formed from any suitable soft resilient material, such as a resilient foamed synthetic resin material, for example, of which polyurethane is preferred.

Since a foamed synthetic resin material is porous and may absorb moisture, the resin material is preferably coated with a very thin, very flexible membrane or film 39 of water resistant material, such as an aqueous urethane emulsion, a low or linear-low density polyethylene, or a plasticized polyvinylchloride, for example. The aqueous urethane coating is preferably applied by spraying or dipping, and the polyethylene and polyvinylchloride coatings preferably applied by casting. The film is so thin, approximately 2 mils in thickness or less, that it does not cause any appreciable wrinkling of the weatherstrip when the weatherstrip is bent abruptly at a corner through a sharp 90 degree angle, as seen in FIG. 2. Wrinkling normally causes moisture leakage which is undesirable.

Weatherstrip 22 is secured in a continuous slot 30 in frame members 12 as best seen in FIGS. 1 and 2. This is achieved by an anchoring member on the weatherstrip comprising an elongate flexible strip of any suitable material, such as paper. Strip 32 is of hook-shaped cross section, and is affixed by any suitable means to anchoring lobe 26 with legs 34, 36 of the hook enclosing an end part of lobe 26 (FIG. 3). Leg 34 adds rigidity to the weatherstrip and assists in guiding the weatherstrip into slot 30. During insertion of the weatherstrip, leg 36 is urged toward leg 34 against the bias of the resilient lobe 26. When fully inserted, lobe 26 urges leg 36 into alignment with slot shoulder 38 (FIG. 1) for releasably securing weatherstrip in slot 30.

Although slot 30 is provided in frame members 12, it could be located on an edge surface of sash 10 for engaging seal surfaces on the frame members. Slot 30 has any suitable cross sectional shape including a shoulder that is complementary to the weatherstrip anchoring member.

Any suitable material having the required flexibility and rigidity may be used for flexible strip 32. A commercially available 22 mil (0.056 cm) weatherstripping paper has been found to be satisfactory. Preferably, the paper strip is latex saturated to make it moisture resistant.

With reference to FIGS. 4–9, other preferred embodiments of the weatherstrip 22 are shown. In these views, parts similar to parts shown in Figs. 1–3 are denoted by the same numbers. The outer shapes of the weatherstrips vary depending upon the configuration of the members to be sealed and the location of the anchoring slot. The embodiments shown in FIGS. 4–9 are illustrative of some of the possible sealing applications.

Figure 8:
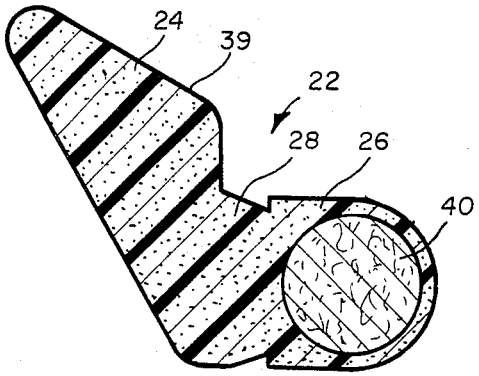
Figure 6:
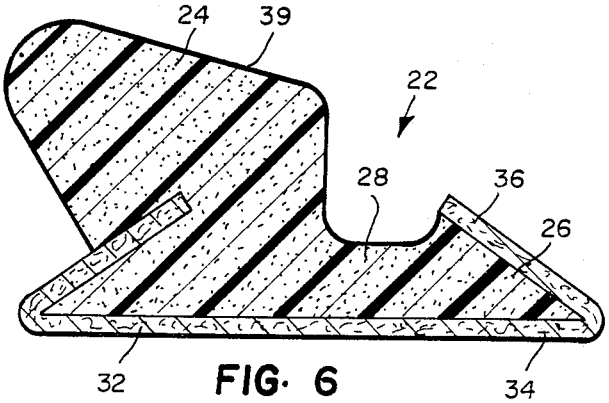
Figure 7:
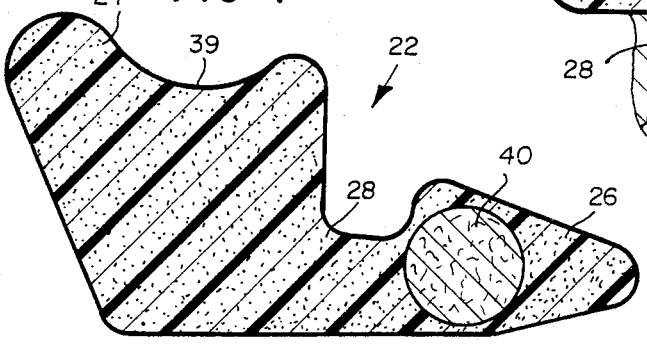
Figure 9:
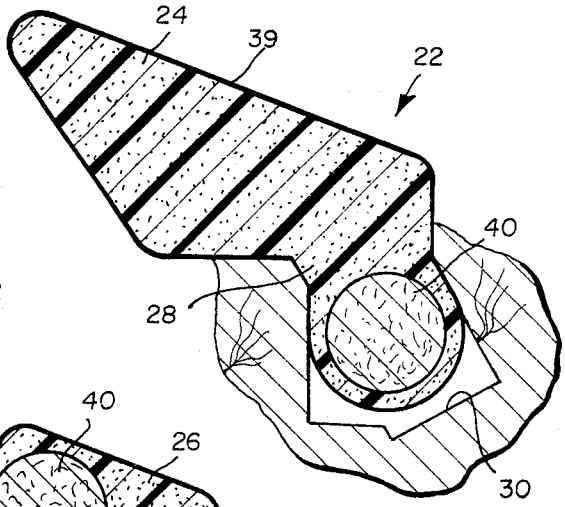

In FIGS. 7–9, the anchoring member comprises a cord 40 of any suitable flexible material, such as paper, for example. Cord 40 is less compressible than the synthetic resin material, but sufficiently compressible to be compressed and forced into and retained in anchoring slot 30.

One of the improvements provided by this new weatherstrip may be more fully appreciated by comparing the coefficents of linear expansion for various materials previously used for anchoring weatherstrips of the type to which this invention is addressed with the coefficients of thermal expansion of the present weatherstrip. As used herein, coefficient of expansion means the coefficient of linear thermal expansion expressed in inches per inch per degree fahrenheit.

Polypropylene copolymer has a coefficient of expansion of about $5\times10^{-5}$. Rigid PVC has a range of coefficients of expansion between about $2.9\times10^{-5}$ and $7.4\times10^{-5}$, $3.8\times10^{-5}$ being typical. Wood, particularly pine, from which many doors and windows of the type to which this invention is addressed are made, has a coefficient of expansion of $2.8\times10^{-6}$. Paper, being made of cellulose, has substantially the same coefficient of expansion as wood. The practical effect of the coefficient of expansion on weatherstrip may be appreciated by considering the following examples. The change in length in a 7 foot strip of weatherstrip over a temperature range of 110° F., −20 to −90, is 0.46 inch for polypropylene copolymer, 0.35 inch for rigid PVC and 0.025 inch for paper. It will be appreciated that the change in length for polypropylene copolymer weatherstrip and rigid PVC weatherstrip is substantial enough to cause a large gap at each end of a piece of weatherstrip thus allowing substantial air infiltration and destroying the sealing integrity of the door or window. A paper backed weatherstrip, on the other hand, exhibits less than 1/10 as much shrinkage and an air tight seal is easily maintained. In fact, since the door or window frame, if made of wood, will match the change in length of the paper backed weatherstrip, no gap will be produced. It will be understood in connection with weatherstrips of this type that the coefficient of thermal expansion of the foam material comprising the sealing bodies is essentially irrelevant, the foam being sufficiently resilient to follow the expansion or contraction of the backing material.

While presently preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An elongate weatherstrip comprising:

an elongate sealing body of resilient foamed synthetic resin material, said sealing bodyhaving a pair of elongate sealing and anchoring lobes joined by a narrow elongate rib portion of resilient foamed synthetic resin material;

a thin flexible moisture resistant coating covering at least said sealing lobe and said rib portion; and a flexible elongate hook-shaped anchoring member of a material less compressible than said synthetic resin material enclosing at least a portion of said anchoring lobe and resiliently biased into an open position by said resin material.

2. An elongate weatherstrip according to claim 1 wherein said anchoring member comprises an elongate paper strip.

3. An elongate weatherstrip according to claim 2 wherein said paper is saturated with latex.

4. An elongate weatherstrip according to claim 1 wherein said thin flexible coating is of a thickness of substantially 2 mils or less.

5. An elongate weatherstrip comprising:

an elongate sealing body of resilient foamed resin material;

said sealing body having a pair of elongate sealing and anchoring lobes joined by an elongate rib portion of resilient foamed resin material;

a thin flexible moisture resistant coating covering at least said sealing lobe and said rib portion; and said anchoring lobe including a flexible elongate generally V-shaped anchoring member having first and second portions defining an acute angle therebetween and including a wedge-shaped portion of resilient foamed resin material therebetween for imparting resiliency to said anchoring member whereby said weatherstrip may be easily inserted into a slot by compressing said V-shaped member and securely held therein by said anchoring member when said V-shaped member expands within said slot.

6. The weatherstrip of claim 5 wherein anchoring member comprises a folded strip of paper.

7. The weatherstrip of claim 6 wherein said strip of paper comprises a strip of latex impregnated paper.

8. An elongate weatherstrip comprising:

an elongate sealing body of resilient foamed resin material, said sealing body having a pair of elongate sealing and anchoring lobes joined by a narrow elongate rib portion of resilient foamed resin material; and a hook-shaped flexible elongate anchoring member of a material characterized by a coefficient of thermal expansion between about $1.0\times10^{-6}$ and $10.0\times10^{-6}$ inches per inch per degree fahrenheit and less compressible than said foamed resin material and enclosing at least a part of said anchoring lobe.

9. The weatherstrip according to claim 8 wherein said anchoring member comprises an elongate paper strip.

10. An elongate weatherstrip according to claim 9 wherein said paper is saturated with a waterproofing material.

11. The elongate weatherstrip according to claim 10 wherein said waterproofing material is latex.

12. The weatherstrip of claim 8 wherein said anchoring member comprises a folded strip of paper.

13. The weatherstrip of claim 11 wherein said strip of paper comprises a strip of latex impregnated paper.

* * * * *